United States Patent [19]

Clough

[11] Patent Number: 4,651,516

[45] Date of Patent: Mar. 24, 1987

[54] FRICTION SPINNING APPARATUS

[75] Inventor: Douglas O. Clough, Rossendale, England

[73] Assignee: Hollingsworth (U.K.) Ltd., Accrington, England

[21] Appl. No.: 810,155

[22] Filed: Dec. 18, 1985

[30] Foreign Application Priority Data

Dec. 18, 1984 [GB] United Kingdom ..... 8431909

[51] Int. Cl.[4] ..... D01H 7/898; D01H 1/135

[52] U.S. Cl. ..... 57/401

[58] Field of Search ..... 57/400, 401, 408, 411

[56] References Cited

U.S. PATENT DOCUMENTS

| | | | |
|---|---|---|---|
| 4,168,601 | 9/1979 | Didek et al. | 57/401 |
| 4,483,136 | 11/1984 | Stahlecker et al. | 57/401 |
| 4,522,023 | 6/1985 | Stahlecker | 57/401 |
| 4,570,434 | 2/1986 | Stahlecker | 57/411 X |

*Primary Examiner*—Donald Watkins
*Attorney, Agent, or Firm*—Cort Flint

[57] ABSTRACT

Friction spinning apparatus comprises a fibre feed duct having a secondary suction port which is linked to a source of suction by way of a second perforated region of the perforated roller. The secondary air passage is communicated to a source of suction by way of the second perforated region having a suction opening formed in a masking sleeve therewithin. Yet a further masking sleeve radially inwardly of the first has two differently sized holes for changing the volume of air flowing through the hole and hence changing the air-flow rate through the secondary air passage.

The secondary air passage can be relatively large in cross-section and the flow constriction of the secondary air path can be by way of the second perforated region of the roller which is self-cleaning and hence avoids blockage of the secondary air path.

8 Claims, 3 Drawing Figures

FRICTION SPINNING APPARATUS

FIELD OF THE INVENTION

The present invention relates to a friction spinning apparatus, and in particular to friction spinning apparatus employing two rollers operating in the same direction of rotation and subject to a primary airflow radially inwardly through at least one of the rollers, which is perforated and a secondary airflow along the rollers for orientating fibres being fed in an airborne stream to the roller surfaces. Such an apparatus is disclosed and claimed in our GB-B No. 2,042,599.

PRIOR ART

In British Patent Specification No. 2,042,599 assigned to the assignees of the present invention, the secondary airflow passing along the surface of the rollers is effected by connecting a source of suction to a port near the downstream end of the fibre feed duct conveying the airborne stream of fibres from an opening unit. Only a relatively low airflow is needed and the suction is carefully balanced in relation to the primary suction which generates airflow radially inwardly to the or each perforated roller, in order that fibres may be re-orientated as they approach the yarn formation line but not to any great extent influenced to pass along the secondary airflow port. However, some fibres have been found to leave through the secondary airflow port and to result in blockage in the flow constriction which is employed in order to achieve the desired balancing of this secondary suction to the primary suction applied through the perforated surface of the or each perforated roller. Such action gives rise to blocking of the secondary suction passageway and can result in loss of yarn quality, while the machine is still operating.

OBJECT OF THE INVENTION

It is an object of the present invention to overcome the disadvantage of fibre blockage in the secondary suction passageway. It is a further object of the present invention to provide a more compact friction spinning unit in which the secondary airflow path passes into the perforated roller.

SUMMARY OF THE INVENTION

In accordance with the present invention there is provided friction spinning apparatus including at least one perforated roller and a fibre feed duct for feeding fibres to a yarn formation line on that perforated roller, wherein the perforated roller has a first perforated region coincident with the yarn formation line and, in use of the apparatus, subject to primary suction to induce flow of fibres towards the yarn formation line, and a second perforated region axially displaced from the first perforated region, and wherein the fibre feed duct includes a secondary airflow port communicating with the second perforated region of said at least one perforated roller, means being provided for subjecting the interior of the perforated roller to suction at both said first and second perforated regions, whereby suction applied at the first perforated region entrains fibres towards the yarn formation line and suction applied at the second perforated region entrains air through said secondary airflow port of the fibre feed duct.

With such an arrangement the air flowing through the secondary airflow port in the fibre feed duct encounters a relatively large cross-section and there is little or no tendency for blockage in the port. On leaving the secondary airflow port the air passes through the second perforated region of the perforated roller and hence to some extent fibres in the secondary airflow port will be screened from passing further down the secondary airflow path and can readily be removed from the second perforated region of the perforated roller, to waste. Alternatively, or possibly additionally, some fibres may pass through the holes in the second perforated region and will have been straightened with respect to the entraining airflow on passing through the holes, and will be able to pass to waste without tendency to block the secondary air passageway.

Advantageously the cross-sectional dimension of each of the holes in the second perforated region may be greater than that of the holes in the first perforated region, to facilitate fibre passage through the perforated roller.

Preferably means may be provided for varying the airflow through the second perforated region between a "yarn-piecing" condition and a "yarn spinning" normal operating condition.

The first and second perforated regions may, if desired, be separated by a further perforated region and/or may be identical to one another.

BRIEF DESCRIPTION OF THE DRAWINGS

In order that the present invention may more readily be understood the following description is given, merely by way of example, with reference to the accompanying drawings in which.

DESCRIPTION OF THE PREFERRED EMBODIMENT

Figure 1:
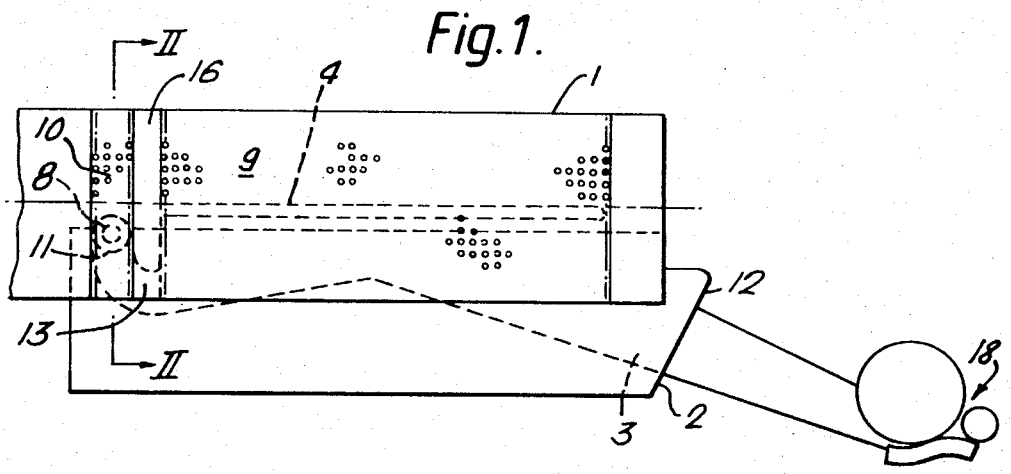
FIG. 1 is a side elevational view of a friction spinning roller and fibre feed duct of a friction spinning apparatus in accordance with the present invention, with one of the friction spinning rollers omitted for reasons of clarity.

As shown in FIG. 1, the friction spinning apparatus includes a perforated or suction roller 1 and a fibre feed duct 2 defining a passage 3 along which fibres are passed to a yarn formation line extending parallel to a generatrix of the roller 1. The attraction of the fibres towards the yarn formation line is achieved by virtue of a parallel-sided slot 4 defined by a masking sleeve within the perforated roller 1. This masking sleeve is shown at 5 in FIG. 2.

Within the masking sleeve 2 is a movable inner mask 6 (FIG. 2) which has a suitably shaped slot co-operating with the parallel-sided slot 4 of the outer masking sleeve 5. One possibility for the shape of this inner slot is for it to be of a parallelogram shape as disclosed in European Patent Specification No. 052 412 which allows the slot to be moved in either of two directions, as appropriate, during piecing and cleaning, but left in a central position in which the full length of the suction slot 4 in the outer masking cylinder 5 is exposed to suction for normal spinning operation.

The same rotatable inner masking sleeve 6 is provided with two holes 7 and 8 of different diameters, for a purpose to be explained below.

The perforated surface of the roller 1 is in this case defined as two distinct and separated areas, namely a first perforated surface region 9 having holes with a cross-sectional dimension as large as possible but not so large that fibres landing on the yarn formation line can pass through those holes in any great numbers, and a second perforated region 10 where the size of the holes can, if desired, be even larger than those in the first perforated region 9. Alternatively the population density of the holes in the second region 10 can be greater than that in the first region 9, or both the population density and hole diameter can be greater in order to provide the desired balancing of the suctions entraining the primary airflow along the parallel-sided slot 4 and the secondary airflow through either of two holes 7 and 8 of the inner masking sleeve and of a further hole 11 of the outer masking sleeve (also shown in FIG. 1).

FIG. 1 also shows that, at its end opposite the location of the connecting flange 12 to a fibre-opening unit 18, the fibre passage 3 of the fibre feed duct 2 is continued in the form of a curving passage portion 13 of substantially constant cross-sectional area.

Figure 3:
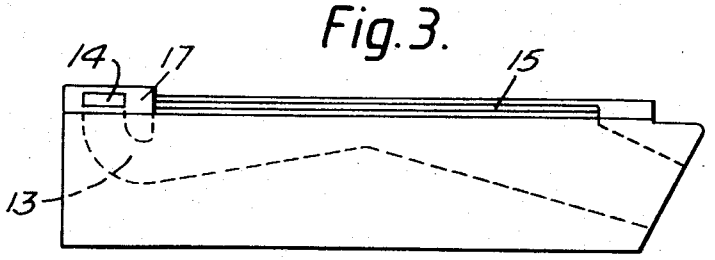
FIG. 3 is a view of the fibre feed duct seen along a direction of arrow III of FIG. 2.

FIG. 3 shows that this curving area 13 terminates at a slot 14 which, although omitted from FIG. 1, normally overlies the hole 11 of the outer masking sleeve 5.

Figure 2:
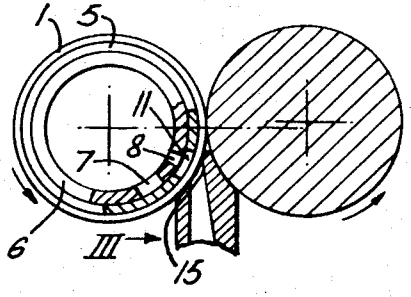
FIG. 2 is a sectional view taken on the line II—II of FIG. 1.

The primary outlet of the fibre feed duct comprises a further parallel-sided slot 15 which is also shown in FIG. 2 and can be seen to be narrower than the outlet 14 for the secondary airflow.

The friction spinning apparatus described above operates in the following manner:

During normal spinning, suction is applied at the hole 11 of the outer masking sleeve 5, and hence at the corresponding area of the external sleeve defining the perforated roller 1, and this is then communicated to the slot portion 14 of the fibre feed duct 2. Additionally primary suction is applied at the slot 4 (FIG. 1) of the outer masking sleeve 5 and hence to the slot 15 of the fibre feed duct 2. The strengths of the suction entraining the primary airflow through slot 15 and the secondary airflow through slot portion 14 are balanced by virtue of the population density and hole sizes in the first perforated region 9 and in the second perforated region 10 of the perforated roller 1. It will be appreciated that between the first and second perforated regions of the roller 1 there is a zone 16 lacking perforations and which needs, therefore, to be bridged by the curved secondary air passage of the fibre feed duct 2. However holes may, if desired, be provided in the region 16 since the discontinuity of the outlet slot assembly 14, 15 of the fibre feed duct will itself provide two distinct regions of suction. The absence of holes in the region 16 serves to sharpen the demarcation between the primary and secondary suctions.

Fibres are detached from a sliver being fed to a beater roller in a conventional fibre-opening unit and the effect of the suction at the slot 15 serves to draw an airborne stream of fibres down the fibre feed passage 3 onto the yarn formation line. The bleed of air at the lefthand end of the fibre feed duct, into the curved secondary air passage 13, helps to orientate the fibres so as to be more nearly parallel to the yarn formation line at the time they join the rolling bundle of fibres forming the yarn, and this action is well described in our said GB-B No. 2,042,599.

Fibres will not pass through the holes in the first perforated region 9 but will enter the rolling bundle of fibres and form yarn which is withdrawn in the rightward direction as viewed in FIG. 1, by way of a doffing tube and withdrawal rollers as disclosed in GB-B No. 2,042,599.

Air, with possibly only a very small number of fibres, will enter the curved secondary air passage 13 and arrive at the surface of the second perforated region 10 by way of the slot portion 14. Those few fibres should pass, with the air through the surface of the second perforated region 10 and into the hole 11 of the outer masking sleeve.

During yarn piecing, the length of seed yarn which is introduced back through the doffing tube and into the vicinity of the yarn formation line is attracted to move along the length of the yarn formation line by an increased secondary airflow which is made possible by rotation of the inner masking sleeve 6 in the anticlockwise direction to bring the larger diameter hole 7 into register with the hole 11 of the outer masking sleeve 5.

However, for normal spinning operation the smaller diameter hole 8 is in register with the hole 11, as illustrated in FIG. 2, so as to provide secondary airflow strong enough to be capable of orientating the fibres in the fibre feed passage 3 but not so strong as to attract those fibres in any great numbers into the curved secondary air passage 13. Thus, in FIG. 1, the smaller diameter hole 8 is shown as being in register with the hole 11 of the outer masking sleeve 5.

In the unlikely event of fibres arriving on the surface of the second perforated region 10 and not being able to pass therethrough, they may be removed to waste, either by centrifugal force or by the scraping action of the surface portion 17 of the fibre feed duct around the slot portion 14, or by means of some separate scraper or other fibre-removing means, as required.

However, most if not all such fibres pass through the holes of the second perforated region 10 and are allowed to pass to waste through the suction passage within the inner masking sleeve 6.

In order to minimise the amount of fibres which fail to pass through the sides of the second perforated region 10 the diameters of those holes can be enlarged as necessary, possibly hand-in-hand with a decrease in population density of the holes to control the strength of the secondary airflow along the secondary air passage 13.

Although not illustrated in the drawings, it may be desirable for additional baffles to be formed within the inner masking sleeve 6 in order to provide some additional means of balancing the primary and secondary suctions, by virtue of a constricted opening in the additional baffle.

FIG. 2 shows two distinct holes 7 and 8 of different diameters, but it would be alternatively possible to achieve the same function by having a tapering slot extending circumferentially of the inner masking sleeve 6 so that bringing the narrower end of the slot in register with the hole 11 is equivalent to having the small diameter hole 8 of FIG. 2 in position, for normal spinning, and bringing the wider end of the slot in register with the hole 11 is equivalent to having the larger hole 7 in register, for piecing purposes.

It will of course be appreciated that, during piecing, the rotation of the inner masking sleeve 6 to bring the hole 7 into register with the hole 11 of the outer masking sleeve 5 will also bring the appropriate side of the parallelogram-shaped slot (not shown) of the inner masking sleeve 6 into its "piecing" position as described in our said EP-A-0,052,412.

Further adjustment of the balance between the primary and secondary airflows to which the fibres in the fibre feed passage 3 are subjected can be achieved by varying the spacing of the surface region 17 of the fibre feed duct 2 from the second perforated surface region of the perforated roller 1.

The particular geometry of the fibre feed passage 3 shown in FIGS. 1 and 3 is capable of considerable variation and is not to be taken as limiting the scope of the present invention. For example, the constant cross-sectional secondary air passage 13 may have a varying cross-section, if desired, and the entire configuration of the fibre feed passage 3 may be different from that shown in FIGS. 1 and 3, in order to adapt the performance of the friction spinning apparatus for as many different yarn counts and yarn types as possible.

The hole cross section and population density may of course be constant along the perforated roller 1, if desired.

Although the perforated roller is in this case cylindrical, it could instead be of any other form, for example a foraminous hyperboloidal roller or a conical roller as is known. It is even conceivable for the cylindrical outer surface of one or both of the rollers to be defined by a belt looped round a support roller.

I claim:

1. Textile friction spinning apparatus of the type which includes a perforated roller means; a fiber feed duct for feeding fibers to a yarn formation line on said perforated roller means; means on the perforated roller reans defining a first perforated region; means for communicating suction to said first perforated region to induce flow of fibers along a fiber feed duct extending from the fiber feed means towards the yarn formation line; means included in said fiber feed duct defining a secondary suction passage; and secondary airflow forming means communicating with the secondary suction passage of said fiber feed duct; wherein the improvement comprises:

a second perforated region included in said perforated roller means axially displaced from the first perforated region;

means for communicating suction to said second perforated region of said perforated roller, said suction communicating means forming part of said secondary airflow forming means; and a secondary suction port of said fiber feed duct communicating with said secondary suction passage means and positioned adjacent said second perforated region of the perforated roller means in a manner that suction applied at the first perforated region entrains fibers toward the yarn formation line, and suction applied at the second perforated region entrains air through said secondary suction port.

2. The apparatus of claim 1 wherein said second perforated region including means defining holes which have a first cross-section, and said first perforated region includes means defining holes which have a second cross-section, said first cross-section being greater than said second cross-section.

3. The apparatus of claim 1 wherein said first perforated region includes means defining holes which have a first population density, and said second perforated region includes means defining holes which have a second population density, said second population density being greater than said first population density.

4. The apparatus of claim 1 wherein the means for comnunicating suction to the first perforated region comprises means defining a first suction path extending to said first perforated region; and the means communicating suction to the second perforated region comprises (a) means defining a second suction path extending to said second perforated region, and (b) means for varying the cross-section of said second suction path.

5. The apparatus according to claim 4 wherein the means for varying the cross-section of the second suction path comprises a masking sleeve within the perforated roller means, and adjustable means defining an opening in said masking sleeve for varying the cross-section of the opening in the masking sleeve between condition positions which correspond to a piecing configuration and a normal spinning configuration.

6. The apparatus of claim 5 wherein said adjustable means defining an opening comprises means defining at least two separate openings, each of which has a different cross section, and wherein the masking sleeve is movable to select either of said openings in cross-sections thereof in order to effect change of the cross-section of the second suction path.

7. The apparatus of claim 1 including an imperforate region of the perforated roller means separating said first perforated region from said second perforated region.

8. The apparatus of claim 1 wherein said fiber feed duct comprises an integral body portion defining a fiber feed passage extending from said fiber opening unit to said yarn formation line, said secondary suction passage means communicating with said fiber feed passage adjacent the yarn formation line, and said secondary suction port communicating with said secondary suction passage means.

* * * * *